US006230819B1

(12) United States Patent
Chen

(10) Patent No.: US 6,230,819 B1
(45) Date of Patent: May 15, 2001

(54) GYRATION/RECIPROCATING ACTION SWITCHING MECHANISM FOR A POWER HAND TOOL

(76) Inventor: Yueh Chen, 4-2 Fl., No. 59, Sec. 2, Tun-Hua South Rd., Taipei (TW)

( * ) Notice: Subject to any disclaimer, the term of this patent is extended or adjusted under 35 U.S.C. 154(b) by 0 days.

(21) Appl. No.: 09/433,790

(22) Filed: Nov. 3, 1999

(51) Int. Cl.[7] ..... B25D 11/00
(52) U.S. Cl. ..... 173/48
(58) Field of Search ..... 173/178, 176, 173/48, 47, 216, 13, 104

(56) References Cited

U.S. PATENT DOCUMENTS 4,489,792 * 12/1984 Fahim et al. ..... 173/48
5,343,961 * 9/1994 Ichikawa ..... 173/178
5,375,665 * 12/1994 Fanchang et al. ..... 173/48
5,451,127 * 9/1995 Chung ..... 173/47
5,505,271 * 4/1996 Bourner ..... 173/48
5,531,278 * 7/1996 Lin ..... 173/176
5,704,433 * 1/1998 Bourner et al. ..... 173/178
5,711,380 * 1/1998 Chen ..... 173/48

* cited by examiner

*Primary Examiner*—Scott A. Smith
(74) *Attorney, Agent, or Firm*—Bacon & Thomas, PLLC

(57) ABSTRACT

An improved vibration attenuator for reducing undesired vibrations generated by cutter bits being drawn across the faces of a rotating brake rotor. The attenuator has friction pads with engagement members that extend therefrom which are configured to cause force to exerted on the cutter bits in a direction parallel to the surface being machined and perpendicular to the direction of rotation of the rotor.

5 Claims, 4 Drawing Sheets

GYRATION/RECIPROCATING ACTION SWITCHING MECHANISM FOR A POWER HAND TOOL

BACKGROUND OF THE INVENTION

The present invention relates to a vibration attenuator for attenuating the vibration caused during the machining or resurfacing of a disc brake rotor by a pair of cutter bits.

After a period of use the faces of disc brake rotors of automobiles, trucks and the like become worn unevenly. A characteristic pattern of circumferentially arranged ridges and valleys develops which interferes with optimum braking action. Additionally the rotors may become warped which could also have an adverse effect on the vehicle's braking capability as well as the undesirable effect of transmitting a pulsing to the brake pedal. The grooves and/or warpage must be removed by resurfacing or machining the face of the rotor. Typically, this is done by mounting the rotor on an arbor assembly for rotation by a brake rotor lathe. A pair of cutter bits are moved by the lathe carriage across the faces of the rotating rotor to cut enough of the material away to render the faces flat or planar. During this operation the cutter bits and rotor typically produce loud, screeching noises which are not only unpleasant for the lathe operator and others in the vicinity, but the accompanying vibrations of the rotor and bits can adversely affect the accuracy of the machining. The vibration may also have an adverse effect on the bits causing them to over heat and wear prematurely.

Various means have been advanced to attenuate or eliminate such vibrations. One system employs damping pads designed to bear against the opposite faces of the rotor in a position out of the way of the cutter bits. The pads are carried by a relatively complex mounting structure which is secured to the brake lathe. Precise adjustment of the position of the pads is required, and an elaborate linkage arrangement is provided to accomplish this. The arrangement is relatively complex and costly, requires subtle adjustments, and is only partially effective in damping the machining noises.

Another system of the prior art utilizes a resilient band adapted to be stretched and placed about the circumference of the rotor. One must purchase a set of such bands to accommodate each of the various sizes of rotor to be machined. The system is unsatisfactory for that reason, and also because the vibration attenuation is not always adequate.

Yet another arrangement of the prior art employs a U-shape rod or handle which mounts a pair of friction resistant pads at its extremities. The pads are placed in position to bear against the opposite faces of the rotor to thereby damp rotor vibration. However, the pads are not effective to attenuate cutter bit vibrations.

U.S. Pat. No. 4,531,434 describes a device wherein two friction pads are biased against the rotor surfaces while the rotation of the rotors then forces the pads against the cutter arms and bits. Pins projecting from the pads engage the cutter arms to automatically maintain the pads in radial position relative to the arms or bits as they are gradually drawn across the faces of the rotor. However, its use in many lathe configurations is compromised in that the cutter bits must be extended an inordinate distance from the cutter arms in order to provide direct access to the bits by the pads. Although the resulting direct contact of the bit enhances the attenuating effect, the extension of the bit substantially offsets such effect as significantly greater vibration is being generated. Additionally, the handle of the device described in the patent interferes with the lathe carriage of many lathe systems which forces the pads to be angled relative to the bits and therefore further diminishes their efficacy. Further, in certain brake rotor lathe configurations, the cutter bit is attached to the cutter arm by a fastener that interferes with the direct contact of the bits by the attenuator pads as the pads are driven towards the bits by the rotation of the rotor. While such attenuator mechanism is fairly effective in attenuating the vibration, further improvement is desirable.

SUMMARY OF THE INVENTION

The vibration dampener of the present invention improves over previously known devices in that it is configured in such a manner so as to cause the force exerted on a brake rotor lathe's cutter bits to be oriented in a direction substantially perpendicular to the direction of rotation of the workpiece. The device functions in cooperation with a brake rotor lathe that has its cutter bits held in place on their respective cutter arms by a fastener with a raised head. By engaging the side of such raised head, force exerted by the attenuator is transferred to the bit in the appropriate direction.

An attenuator constructed in accordance with the present invention generally includes two friction pads fitted to two arms that are arranged in an opposed relationship wherein a spring extending between the arms biases the arms and hence the two pads towards one another so as to grasp a workpiece being rotated therebetween. The two arms are joined at their proximal ends to define a handle. More particularly, each of the friction pads includes a protruding engagement nub that is configured for contacting the side of raised head of a fastener serving to affix the cutter bit to the cutter arm. The handle is configured to enable the engagement nub to engage the side of the fastener at the appropriate angle.

These and other features and advantages of the present invention will become apparent from the following detailed description of a preferred embodiment which, taken in conjunction with the accompanying drawings, illustrates by way of example the principles of the invention.

DETAILED DESCRIPTION OF THE PREFERRED EMBODIMENTS

The attenuator device of the present invention is pinched on to a brake rotor during its resurfacing to reduce the noise that would otherwise be generated, to enhance the effectiveness of the machining operation and to extend the service life of the cutter bits.

Figure 1:
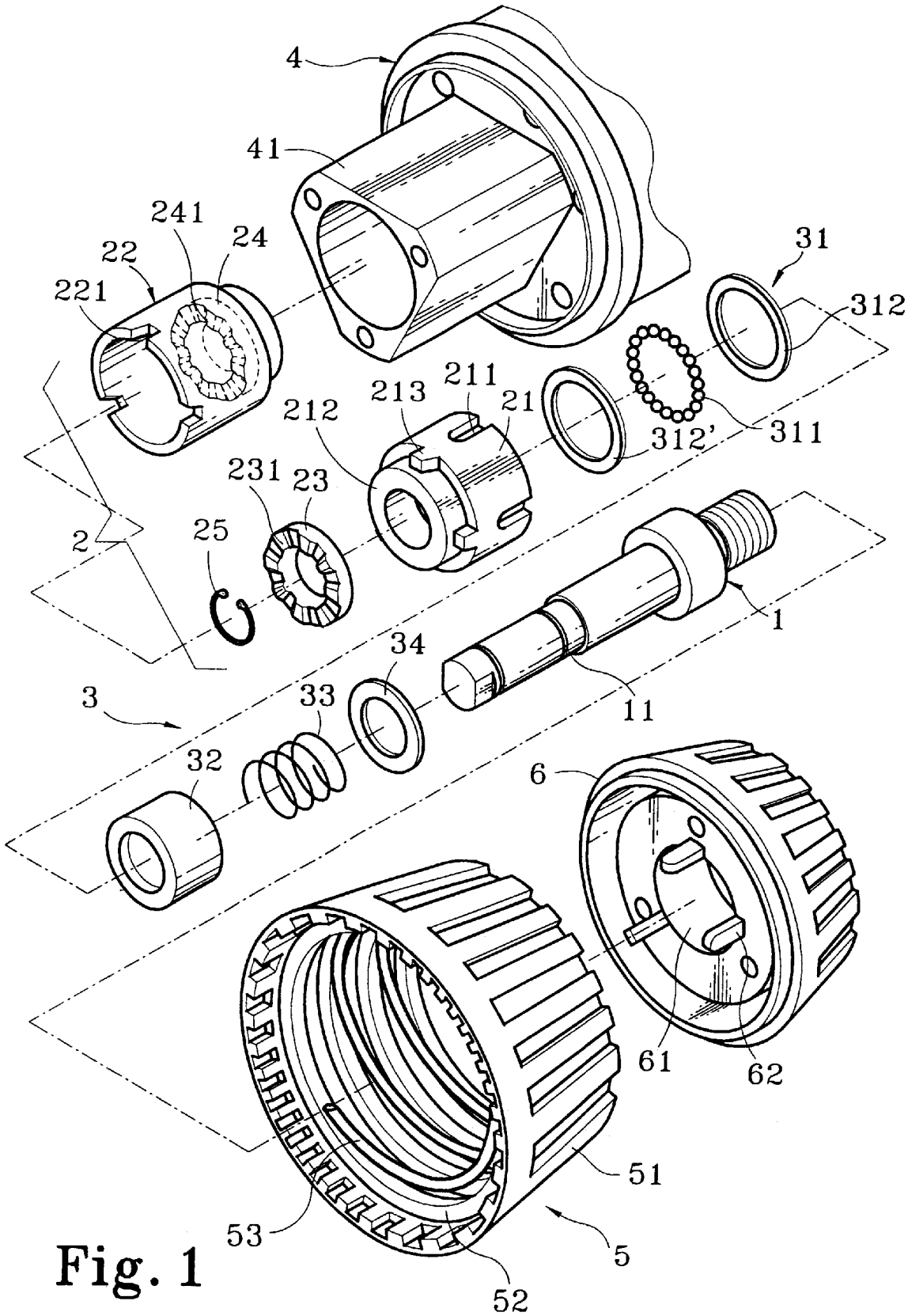
FIG. 1 is a perspective view of the attenuator device in position on a brake rotor lathe.

FIG. 1 generally shows the device 42 of the present invention in position on a brake rotor 44 during a machining operation. The brake rotor is being rotated by the lathe arbor 46 in direction 47 and cutter bits 48 affixed to ends of cutter arms 50 are gradually drawn across the face of the rotor by the lathe's carriage 52 in a radially outward direction. The two cutter bits are held against the two faces of the rotor such that both faces of the rotor are simultaneously machined in a single machining operation.

Figure 2:
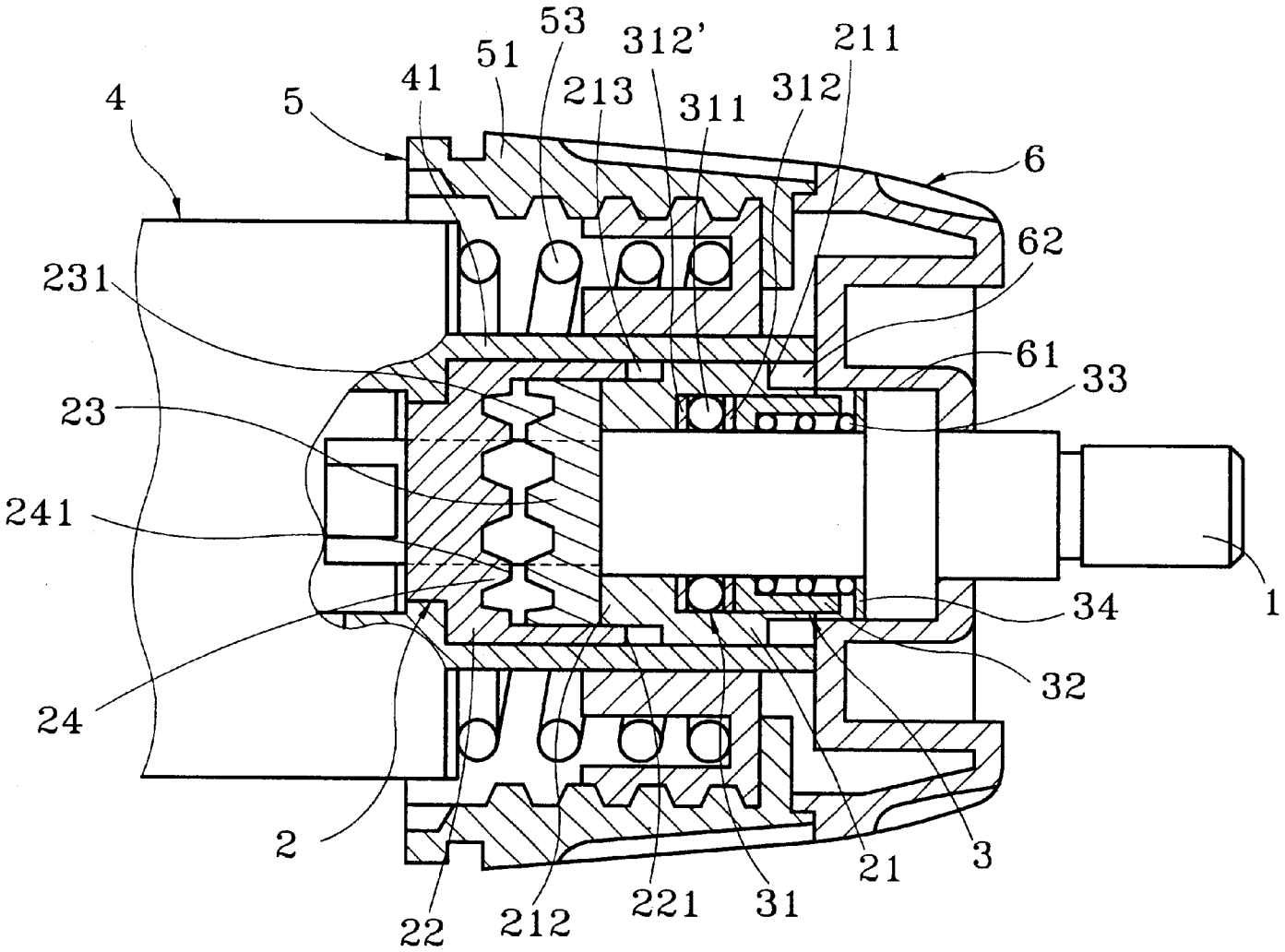
FIG. 2 is an enlarged perspective view of the device of the present invention.

FIG. 2 illustrates the attenuator 42 of the present invention. The device consists of a pair of friction pads 54 attached to a pair of arms 56 that are joined at their proximal ends to define a handle 58. A tension spring 60 biases the arms and pads towards one another. Extending from the bottom of the pads are engagement nubs 62.

Figure 3:
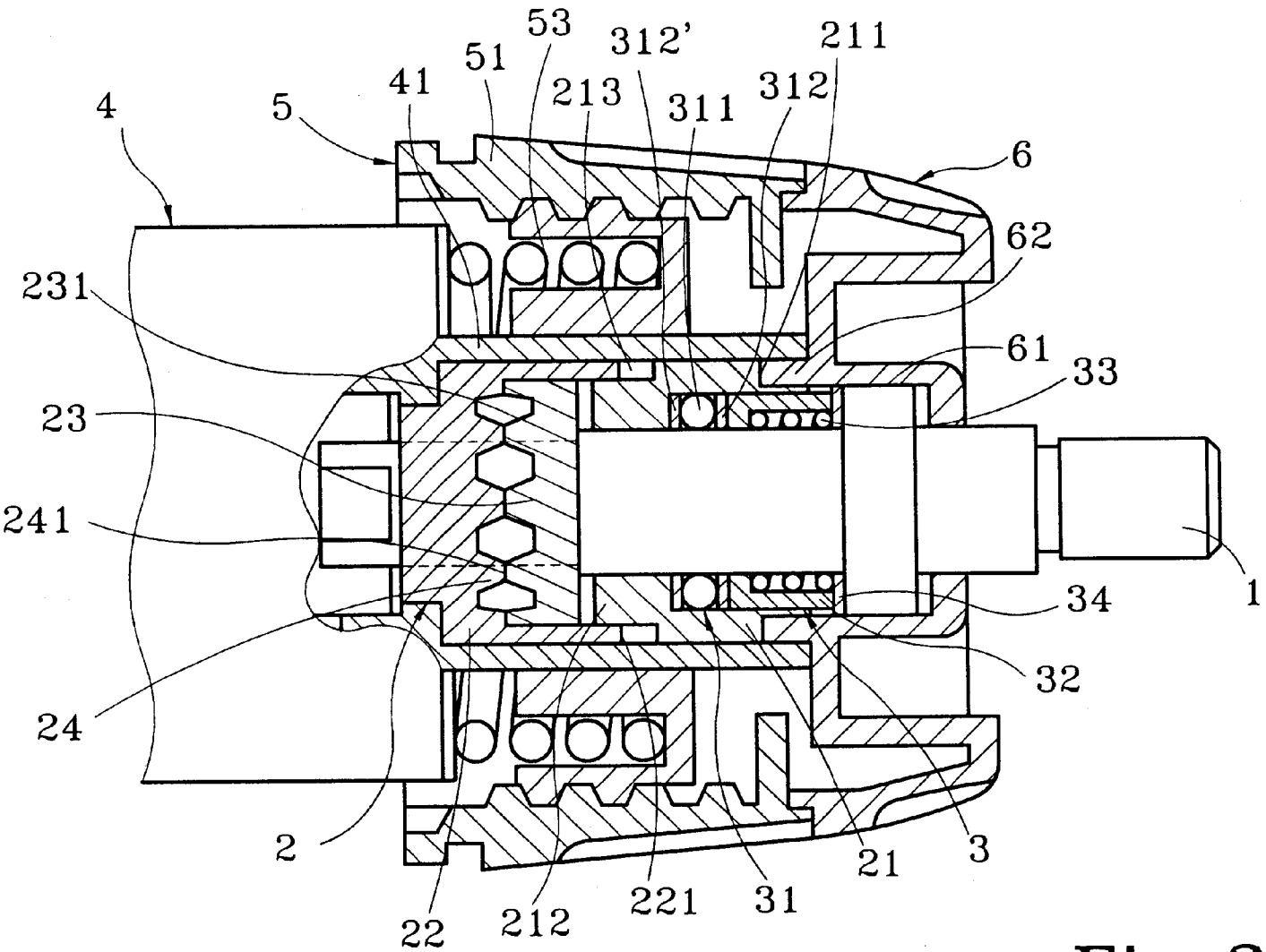
FIG. 3 is an enlarged side view of the attenuator in position on the lathe.

FIG. 3 illustrates the interaction of the attenuator with the lathe components. The cutter bit 48 is attached to the cutter arm 50 by a fastener 64 that extends through the bit and is threaded into the arm. The fastener has a raised head 66 such as for example an Allen head. The pad is shaped so as to allow the engagement nub 62 to fully engage the side of the raised fastener so that force is applied in a direction perpendicular to the direction of rotation of the workpiece 44 and perpendicular to the longitudinal axis of the fastener. The attenuator arms 56 are shaped to similarly allow the engagement nub to properly contact the fastener head. Such shaping may take the form of an offset 65 in the handle to allow the proximal end of the handle to clear any lathe components that would otherwise cause the undesirable angling of the pads 54 and hence the engagement nubs 62.

Figure 4:
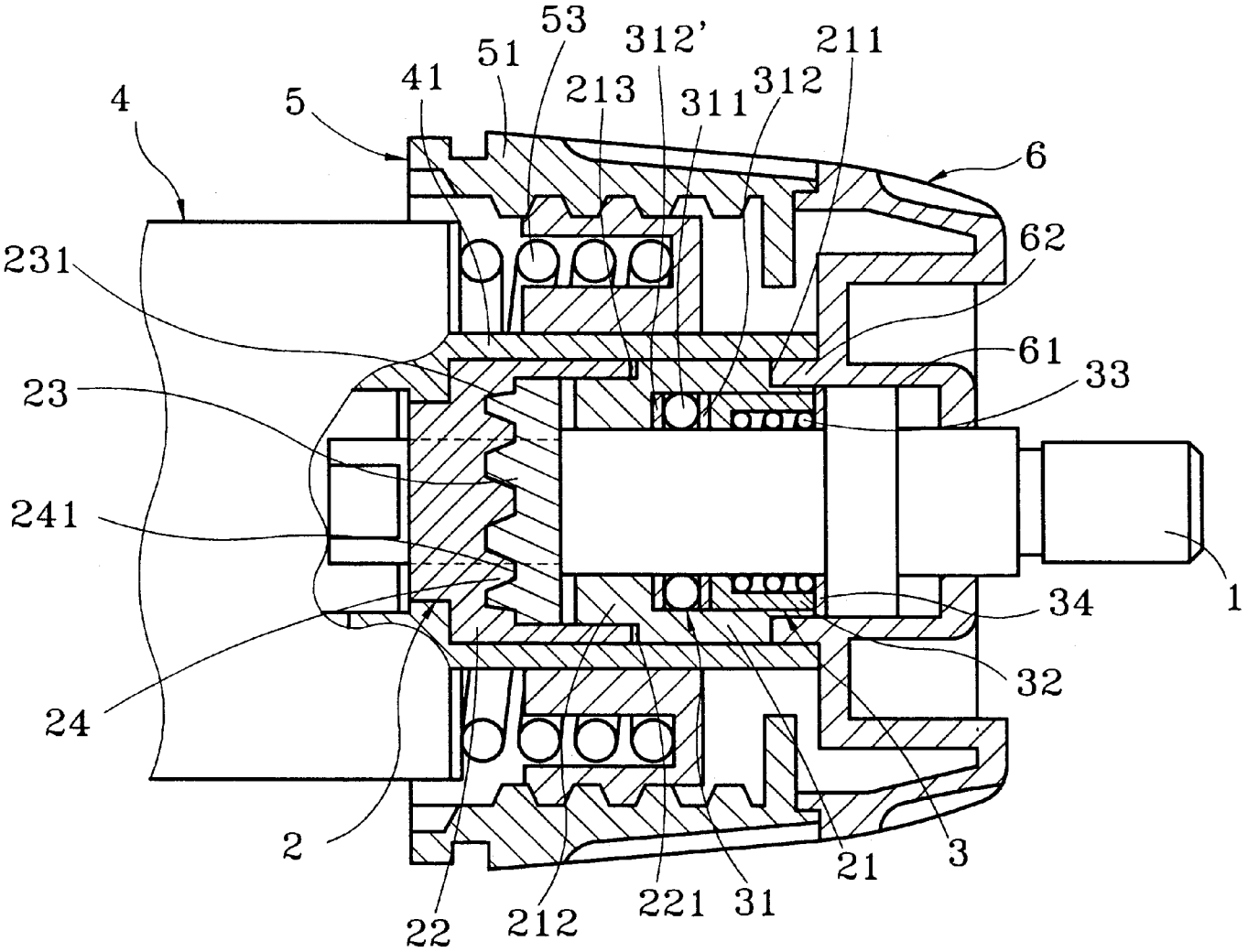
FIG. 4 is an enlarged cross-sectional view taken along lines IV—IV of FIG. 1.

FIG. 4 is cross-sectional view taken through the rotor 44 and radially outwardly to illustrate the relationship of the pads 54, and more specifically, the engagement nubs 62 with respect to the head 66 of fastener 64. While the rotation of the rotor in direction 47 causes the pads to be driven against arms 50, the gradual movement of the lathe carriage 52 in a radially outward direction causes the fastener heads 66 to be driven against the engagement nubs 62. Resistance by the pads being urged against the rotor generates the resistive force that serves to attenuate the undesired vibration.

The pads 54 are each initially about ⅜" each thick and are formed of brake lining material. The engagement nubs are an integral part of the pad extend downwardly approximately ⅜". The arms 56 and handle 58 are formed of stainless steel wire and extend about 7½" from the pads. The offset 65 in the handle is about ⅜". An attenuator of the present invention with such dimensions is ideally suited for use with a brake rotor lathe sold under the trademark PRO-CUT.

The attenuator device 42 of the present invention is fabricated by cutting brake lining material to size to form the pads 54 with integral engagement nubs 62. Slightly undersized holes are then drilled in the edges to receive the arms 56. The components are forced together and are held in place by the resulting friction fit. The handle is then dipped in a rubber or other suitable resilient plastic material that provides an non-slip surface. The spring 60 is clipped into place to complete the assembly process.

In use, the attenuator device of the present invention is pinched onto the rotor being turned by the lathe. The friction generated by the pads 54 being forced against the rotor 44 surfaces by spring 60 causes the device to be forced in the direction of rotation (47) until the engagement nubs 62 make contact with the cutter arms 50. The shape of the pads 54 and the shape of the handle 58 allows the side of the engagement nub to make full contact with the side of the raised head 66 of fastener 64 that serves to attach the cutter bit 48 to cutter arm 50. As the lathe carriage 52 is gradually drawn radially outwardly, the raised fastener heads are driven against the engagement nubs wherein resistance of the pads against the rotor creates a resistive force oriented perpendicular to the direction of rotation of the workpiece. Such force is transferred to the cutter bit and serves to attenuate the undesired vibrations.

While a particular form of the invention has been illustrated and described, it will also be apparent to those skilled in the art that various modifications can be made without departing from the spirit and scope of the invention. Accordingly, it is not intended that the invention be limited except by the appended claims.

What is claimed is:

1. A vibration attenuator for attenuating vibrations generated during the resurfacing of a brake rotor by a brake rotor lathe, wherein two cutter bits, each supported by a cutter arm, are gradually drawn across the brake rotor surfaces as such rotor is being rotated and wherein each of said cutter bits is affixed to the cutter arm by a fastener having a raised head with a surface facing the direction in which said cutter bit is drawn across the brake rotor surface, comprising:

a pair of friction pads each having an engagement nub protruding therefrom and extending across the entire thickness of said pad, configured for engaging said surface of one of said raised heads; and a spring means for biasing said pads against said rotor, whereby said raised head is driven into said engagement nub as said cutter arms are drawn across said brake rotor which is resisted by friction generated by said pads biased against said rotor by said spring means.

2. The vibration attenuator of claim 1, wherein each of said pads is shaped so as to enable said nub to engage said surface of said fastener head in its entirety.

3. The vibration attenuator of claim 1, further comprising arms extending from said pads to which said spring means is attached, wherein said arms are shaped to enable each of said nubs to engage said surface of one of said fastener heads in its entirety.

4. The vibration attenuator of claim 1, wherein each of said nubs is an integral part of the respective pad.

5. The vibration attenuator of claim 4, wherein said pad and nub are formed of a single piece of brake lining material.

* * * * *